United States Patent [19]

Sheffer

[11] Patent Number: 4,653,817

[45] Date of Patent: Mar. 31, 1987

[54] STUDENT DESK

[75] Inventor: Phil B. Sheffer, New Oxford, Pa.

[73] Assignee: Merchandising Innovations, Inc., Hanover, Pa.

[21] Appl. No.: 807,696

[22] Filed: Dec. 11, 1985

[51] Int. Cl.[4] ..... A47B 3/06

[52] U.S. Cl. ..... 312/195; 108/150; 248/174

[58] Field of Search ..... 108/150, 153, 157, 56.3; 248/174, 168; 312/195

[56] References Cited

U.S. PATENT DOCUMENTS

| | | | |
|---|---|---|---|
| 2,003,821 | 6/1935 | Blake | 108/157 X |
| 2,261,280 | 11/1941 | Pennebaker et al. | 248/174 X |
| 2,361,875 | 10/1944 | Sachs | 108/150 X |
| 3,212,464 | 10/1965 | Stever | 108/150 X |
| 3,428,003 | 2/1969 | Heffernan | 108/56.3 X |
| 3,566,808 | 3/1971 | Slate, Jr. | 108/153 |
| 3,685,463 | 8/1972 | Francis | 108/56.3 |
| 3,705,557 | 12/1972 | Budington | 108/150 |
| 3,871,726 | 3/1975 | Stegner | 108/157 X |
| 4,078,502 | 3/1978 | Barna | 108/150 |
| 4,138,951 | 2/1979 | Nelson | 108/115 |

*Primary Examiner*—Peter A. Aschenbrenner

*Attorney, Agent, or Firm*—Daniel J. O'Connor

[57] ABSTRACT

An easy-to-assemble and highly durable and attractive student desk kit. The kit is comprised preferably of corrugated fiberboard materials with the inventive concepts also applicable to a wide range of other material uses.

The unique design of the factory pre-cut component parts permits a method of construction which may be effected without tools and by personnel unskilled in furniture assembly, thus rendering the student desk kit highly marketable.

The light-weight preferred materials and knockdown features greatly reduce shipping costs as compared to other furniture articles, thereby significantly reducing unit cost to the consumer and enhancing sales potential.

1 Claim, 1 Drawing Figure

STUDENT DESK

Figure 1:
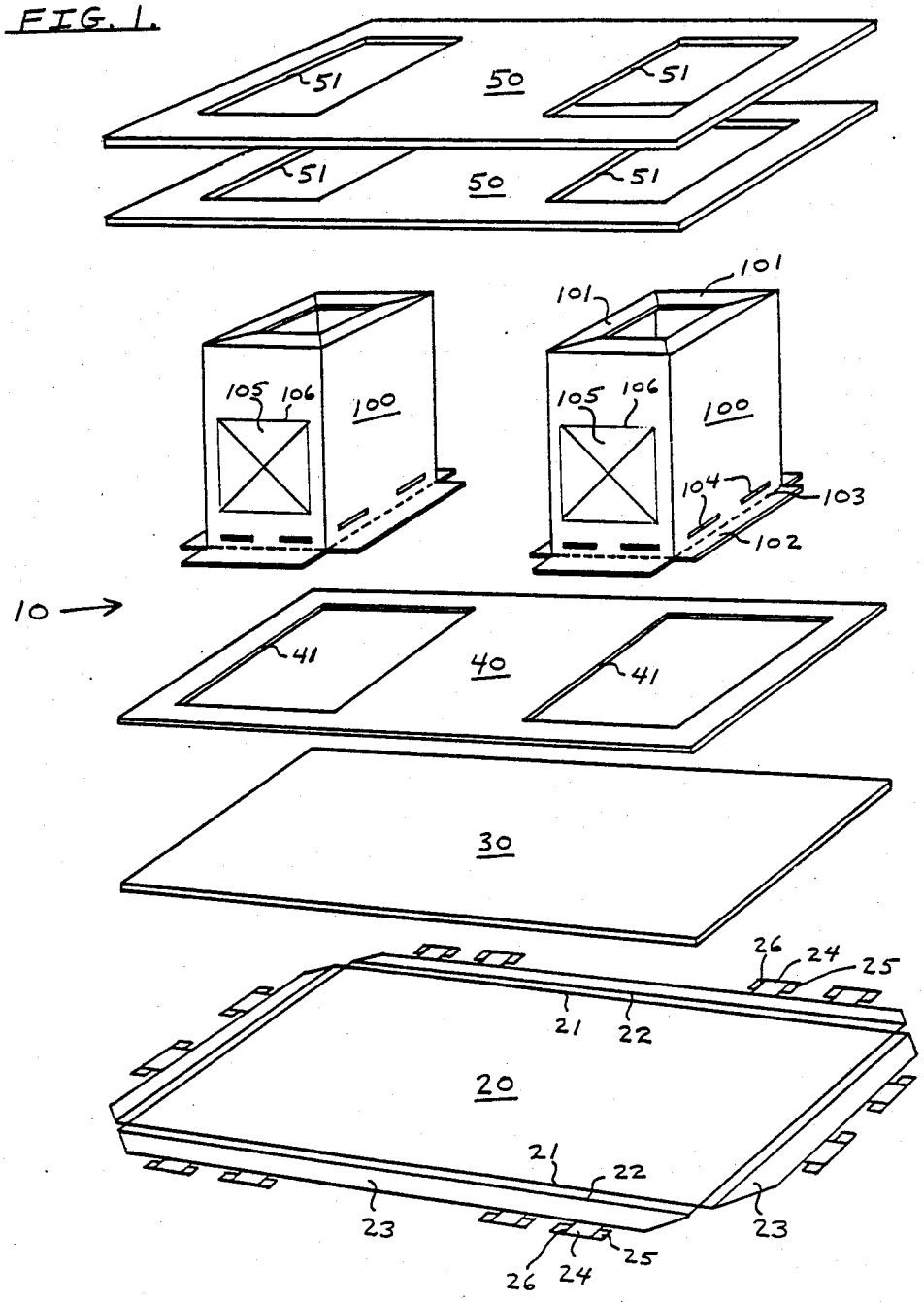

Papers relating to the present invention were previously filed under the Disclosure Document program of the U.S. Patent Office.

BACKGROUND OF THE INVENTION

The high cost of such widely used furniture items as tables and desks is well-known in the furniture arts.

One component of the high cost of such items is the materials used, i.e. typically woods, plastics or metals.

Another cost component of tables and desks is the skilled labor involved in assembling such items.

A further cost component involves the high shipping weight and large shipping areas required for tables and desks. Further, warehousing costs for tables and desks are high because of the space requirements involved in such products.

Prior art tables and desks which are shipped to the user in a disassembled form typically require complex assembly procedures and multiple fasteners or glue to complete the assembly.

It would therefore be desirable in the art to provide table and desk furniture with reduced shipping weight and volume, which can be easily assembled by the purchaser without fasteners, and which in assembled form is a durable and attractive addition to a home or office environment.

PRIOR ART PATENTS

The most relevant prior art patents presently known to applicant are as follows: U.S. Pat. No. 3,871,726 issued to Stegner; U.S. Pat. No. 3,837,719 issued to Barron; U.S. Pat. No. 3,807,823 issued to Rouse.

Each of the above patents illustrates paperboard desk furniture which requires overly complex manufacturing and assembly techniques thus rendering such designs unsuitable for widespread use.

Prior art paperboard furniture in general has not been widely used because of its instability under normal home or office conditions.

Those prior art systems which have achieved a relatively stable end product design have required multiple separate mechanical fasteners which increase manufacturing quality control problems and prove cumbersome in assembly for the average consumer. The costs of such units has also rendered them non-competitive in the general marketplace.

There thus exists a need in the art for desk-type furniture which may be easily assembled and also results in a solid and attractive end product.

OBJECTS OF THE INVENTION

Accordingly, it is an object of the present invention to provide table or desk furniture which is fabricated of a material which is light in weight for shipping and handling cost reductions.

It is a further object of the invention to provide table or desk furniture which may be shipped in a flat, knockdown or disassembled form to reduce shipping volume and warehousing volume requirements.

It is a further object of the present invention to provide table or desk furniture which may be easily and quickly assembled into a durable and highly attractive unit without the need for fasteners or glue by the user.

It is a further object that the assembly of the invention furniture be able to be accomplished by unskilled personnel or by homeowners unfamiliar with furniture assembly techniques.

Further objects and advantages of the present invention will become apparent as the following description proceeds, and the features of novelty characterizing the invention will be pointed out with particularity in the claims annexed to and forming a part of this specification.

BRIEF SUMMARY OF THE INVENTION

The invention utilizes corrugated fiberboard layers which serve to entrap pedestal means without the need for separate mechanical fasteners.

A top wrapping layer serves to entrap or interlock the various lower layers which securely retain the pedestal means in position.

All components are factory pre-cut in a unique design which allows the above assembly.

Importantly, all components are made of the lightweight fiberboard to reduce shipping weight costs and all components are designed to be shipped and warehoused in a flat or knockdown position to reduce space requirements.

The unique inventive design allows multiple fiberboard layers to be built-up and interlocked into an end product which is very sturdy and attractive in appearance.

BRIEF DESCRIPTION OF THE DRAWING FIGURE

FIG. 1 shows the unit in exploded view to clearly illustrate the various assembly components.

FULL DESCRIPTION OF THE PREFERRED EMBODIMENT

Reference is now made to the drawing FIG. 1 in which the student desk 10 assembly components are clearly shown.

It is noted that the top of the student desk is shown in the lower part of FIG. 1 to illustrate the method by which the device is assembled, i.e. the top wrapping layer 20 is placed on the floor or other work surface and the various other components of the student desk are stacked on top of layer 20 for assembly as will be further explained.

The top wrapping layer 20 has inner score lines 21 and outer score lines 22 to enable an inward folding of flaps 23 at the appropriate time. Flaps 23 have attached thereto a plurality of tab elements 24.

Each tab 24 has bendable ears 25 formed thereon via the score lines 26.

It is noted that top layer 20, as well as the other components of the unit, are factory pre-cut utilizing known steel rule die technology so that no materials modification is required by the ultimate user other than the simple bending of pre-scored elements.

A top pad 30, formed of pre-cut corrugated fiberboard, is positioned on top wrap 20 as to lie at or just inside the boundaries formed by inner score lines 21.

Next, a center pad 40 is placed on top pad 30. Center pad 40 has aperture means 41 pre-cut therein as shown. Center pad 40 is also made of corrugated fiberboard.

Shown in the drawing above center pad 40 are the pedestal means 100. Pedestal means 100 has flaps 101 which are turned inwardly and will serve as the floor contacting portion of the student desk when completely assembled. The student desk pedestal means 100 comprises two separate pedestals as shown in FIG. 1. It further includes cut through portions 105 which hinge on score lines 106. When folded inwardly, the cut sections 105 will receive a cube insert means for retaining books, etc., said cube insert to be more fully described in a separate and related document.

Pedestal means 100 also has horizontal slots 104 formed on the sides thereof for eventual receipt of locking tabs 24 of the top wrap layer 20.

Pedestal means 100 further has flaps 102 which are folded outwardly by means of perforated score lines 103.

The pedestal means 100 is factory pre-cut and preglued so that it may be shipped flat and easily expanded into the configuration shown in the drawing.

The pedestal means 100, when arranged as shown, is then positioned so that the outer edges of flaps 102 lie just within the aperture means 41 of center pad 40, center pad 40 having previously been positioned over pads 30 and 20.

Thus center pad 40, in addition to building up the thickness of the student desk, acts to align the pedestal means 100 in proper location relative to the remainder of the student desk structure without the need for measurement or tools by the user.

Shown above pedestal means 100 are two pedestal flap retaining pads 50. Each pad 50 has aperture means 51 pre-cut therein and sized so as to just slide over the main body portion of pedestal means 100. Thus, pedestal flaps 102 are held in position by the area of pads 50 just outside aperture means 51.

The pads 20, 30, 40 and 50 are then pushed tightly together by exerting force on the uppermost pad 50. When the pads are pushed together, slots 104 of pedestal means 100 are visible over the pads 50.

Next, the flaps 23 of the top wrap layer are folded over so taht tabs 24 enter slots 104. Then, the assembler reaches into the interior of the pedestal means and turns ears 25 downward so as to securely retain the tabs 24 in their respective slots 104.

The unit is now completely assembled and may be easily lifted and turned to its upright usable position with flaps 101 of pedestal means 100 contacting the floor.

It is noted that the distance between score lines 21 and 22 is such that it will accommodate the thickness of layers 30, 40 and the two retaining pad layers 50. Thus, the end result is a built-up solid student desk top which is very solid and durable while still retaining the essential light-weight features of corrugated fiberboard.

While corrugated fiberboard is the preferred material of all component parts of the invention, it is recognized that the unique retaining and interlocking features of the present design may be effectively used with other materials known in the art. It is intended to cover all such other material usages within the spirit and scope of the present invention.

The use of corrugated fiberboard material in the manner described is believed to be of far-reaching significance in the furniture arts.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A student desk assembly kit comprising:

a top layer (20) having tab means (24) formed thereon, pad means (30, 40, 50) formed so as to be positionable on said top layer (20), pedestal means (100) designed to be held in place solely by way of said pad means (30, 40, 50) and said tab means (24) formed on said top layer (20), wherein said top layer (20) has inner and outer score line means (21, 22) formed thereon and flaps (23) formed at the outer portion of said outer score line means (22), wherein said pad means includes a center pad means (40) having aperture means (41) preformed therein, wherein said pedestal means (100) has outwardly folding flap means (102) formed thereon and sized so as to lie just within the aperture means (41) of said center pad means (40) when said flap means (102) are in the outwardly folded position, wherein said pad means includes at least one pedestal retaining pad means (50) having aperture means (51) formed therein and sized so as to slide over the body portion of said pedestal means (100) and to retain the outwardly folding flap means (102) of said pedestal means (100) in an appropriate position relative to said top layer (20), wherein said pad means further includes a solid top pad means (30), wherein said pedestal means (100) includes score line means (106) and cut section means (105) for receiving a storage cube upon assembly of the kit, wherein said pedestal means includes inwardly foldable flap means (101) for contacting a floor surface upon assembly of the student desk kit, wherein said tab means (24) have ear means (25) formed thereon so as to allow locking of said tab means, wherein said pedestal means (100) has slot means (104) formed in at least one side wall thereof and sized for receipt of said tab means (24), wherein said pedestal means (100) includes two pedestals factory preformed so as to be shipped in a flat position and openable into a pedestal shape upon assembly of the student desk kit.

* * * * *